US011771223B2

(12) United States Patent
Madimenos et al.

(10) Patent No.: US 11,771,223 B2
(45) **Date of Patent: *Oct. 3, 2023**

(54) DEPLOYABLE SCREEN SYSTEM

(71) Applicant: Neumodern Studio LLC, Chicago, IL (US)

(72) Inventors: Peter Madimenos, Chicago, IL (US); Corrine V. Madimenos, Chicago, IL (US); Anastasia P. Maravelias, Chicago, IL (US)

(73) Assignee: Neumodern Studio LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/886,203

(22) Filed: Aug. 11, 2022

(65) Prior Publication Data

US 2022/0378200 A1 Dec. 1, 2022

Related U.S. Application Data

(63) Continuation of application No. 17/527,450, filed on Nov. 16, 2021, now Pat. No. 11,419,414.

(60) Provisional application No. 63/115,251, filed on Nov. 18, 2020.

(51) Int. Cl.
*A47B 83/00* (2006.01)

(52) U.S. Cl.
CPC ..... *A47B 83/001* (2013.01); *A47B 2200/12* (2013.01)

(58) Field of Classification Search
CPC ..... A47B 21/00; A47B 2200/0066; A47B 2200/12; A47B 19/08; A47B 83/001
USPC ..... 108/50.01, 50.02; 312/19, 195, 196, 312/257.1, 237, 194
See application file for complete search history.

(56) References Cited

U.S. PATENT DOCUMENTS

| | | | |
|---|---|---|---|
| 1,348,073 | A | 7/1920 | Almy |
| 1,943,282 | A | 1/1934 | Bellavia |
| 5,429,432 | A | 7/1995 | Johnson |
| 5,584,546 | A | 12/1996 | Gurin et al. |
| 5,584,548 | A | 12/1996 | Miller |
| 5,803,562 | A | 9/1998 | Jacobs et al. |
| 6,048,044 | A | 4/2000 | Biggel et al. |
| 6,053,588 | A | 4/2000 | Biggel et al. |
| 6,122,865 | A | 9/2000 | Branc et al. |

(Continued)

*Primary Examiner* — Jose V Chen
(74) *Attorney, Agent, or Firm* — NIXON PEABODY LLP

(57) ABSTRACT

A workstation assembly that can be opened when needed is disclosed. When closed, the workstation assembly can be aesthetically pleasing and can have a reduced footprint. When opened, the workstation assembly can include a deployable screen system capable of deploying an interior screen from a door section of the workstation assembly. The screen can provide a backdrop for videoconferencing, can provide improved isolation (e.g., sound isolation, visual isolation, shared airflow isolation, and the like) for an individual within the opened workstation assembly. The deployable screen system can also include an exterior screen for providing an aesthetically pleasing exterior and improved isolation while the workstation assembly is in use. The workstation assembly can also include a surround frame with openings and light sources to provide diffuse illumination to the environment surrounding the workstation assembly, which can be especially useful when natural light is unavailable.

20 Claims, 12 Drawing Sheets

(56) References Cited

U.S. PATENT DOCUMENTS

| | | | | |
|---|---|---|---|---|
| 6,402,271 | B1 | 6/2002 | Kelley et al. | |
| 6,692,092 | B1 | 2/2004 | Evans | |
| 6,719,384 | B1 | 4/2004 | Parise et al. | |
| 6,739,096 | B2 | 5/2004 | Feldpausch et al. | |
| 6,996,939 | B1 | 2/2006 | Jackson | |
| 7,377,078 | B2 | 5/2008 | Golino et al. | |
| 9,884,321 | B2 | 2/2018 | Huester et al. | |
| 11,419,414 | B2 * | 8/2022 | Madimenos ..... | A47B 83/001 |
| 2008/0211361 | A1 | 9/2008 | Boxenbaum et al. | |
| 2011/0037360 | A1 | 2/2011 | Jakins et al. | |
| 2011/0239908 | A1 | 10/2011 | Nakamura et al. | |
| 2015/0233114 | A1 | 8/2015 | Hoefler | |
| 2015/0300010 | A1 | 10/2015 | Loffler et al. | |
| 2016/0166057 | A1 | 6/2016 | Hubert et al. | |
| 2018/0044982 | A1 | 2/2018 | Wang | |
| 2020/0288867 | A1 | 9/2020 | Knapp et al. | |

* cited by examiner

DEPLOYABLE SCREEN SYSTEM

CROSS REFERENCE TO RELATED APPLICATIONS

The present application is a continuation of U.S. Non-Provisional patent application Ser. No. 17/527,450 filed Nov. 16, 2021 and entitled "WORKSTATION ASSEMBLY," which claims the benefit of U.S. Provisional Patent Application No. 63/115,251 filed Nov. 18, 2020 and entitled "WORKSTATION ASSEMBLY," the disclosure of which is hereby incorporated by reference in its entirety.

TECHNICAL FIELD

The present disclosure relates to furniture generally and more specifically to movable office/workspace furniture.

BACKGROUND

Various types of furniture exist to provide a workspace for an individual. Workspace furniture can often include items such as desks, chairs, file drawers, cabinets, partitions, and the like. However, use of such workspace furniture can occupy large amounts of space and can appear aesthetically unpleasing. Further, such workspace furniture may often be used in enclosed environments having little or no natural light. There are needs for improvements in existing workspace furniture, including improved furniture able to be used in many environments, able to incorporate multiple pieces of workspace furniture in a convenient enclosure, able to look aesthetically pleasing, and/or able to provide desirable lighting.

Additionally, the recent pandemic has shown that there are new needs for improved workspace furniture. For example, there is a need for workspace furniture that can provide improved safety, especially in common work environments. There is also a need for workspace furniture that can provide improved convenience for videoconferencing and other remote communication methods, especially as more individuals work from home or otherwise interact with others remotely on a more regular basis.

SUMMARY

Certain aspects and features of the present disclosure include a workstation assembly, comprising: a stationary section having a rear wall panel, a first side panel, a second side panel, and a work surface, the work surface being positioned between the first side panel and the second side panel; a door section rotatably coupled to the stationary section at the first side panel, the door section rotatable between a closed position and an open position; and a deployable screen system coupled to the first door section, the deployable screen system comprising: a roller housing coupled to the door section; a roller assembly positioned within the roller housing and rotatable about a roller axis; a slidable end panel coupled to the roller housing by a support linkage, the slidable end panel movable between a retracted position adjacent the roller housing and an extended position spaced apart from the roller housing; and a screen having a first end supported by the slidable end panel and a second end supported by the roller assembly, the roller assembly providing a biasing force to wrap a portion of the screen about the roller assembly when the slidable end panel is in the retracted position, wherein movement of the slidable end panel to the extended position unwraps at least some of the portion of the screen from the roller assembly.

In some cases, the door section is supported by a caster movable on a floor, and wherein the slidable end panel is supported by an additional caster movable on the floor. In some cases, the stationary section further includes a movable computer equipment support movable between an extended position and a retracted position, wherein movement of the door section to the closed position induces movement of the movable computer equipment support to the retracted position. In some cases, the workstation assembly further comprises an additional door section rotatably coupled to the stationary section at the second side panel, the additional door section rotatable between a closed position and an open position, wherein an inner surface of the door section faces an inner surface of the additional door section when the door section is in its open position and the additional door section is in its open position. In some cases, the door section has a width extending from the first side panel, wherein the additional door section has an additional width extending from the second side panel, and wherein the width of the door section is greater than the additional width of the additional door section. In some cases, the door section comprises an interior wall having a slot, wherein the slot of the interior wall of the door section fits around the work surface when the door section is in the closed position.

In some cases, the workstation assembly further comprises a surround frame positioned around the stationary section, the surround frame having one or more light sources. In some cases, the surround frame comprises a plurality of openings, wherein each of the plurality of openings comprises: a front aperture; a respective one of the one or more light sources; and a divider separating the respective one of the one or more light sources from the front aperture, the divider being transparent or translucent In some cases, each of the plurality of openings further comprises a surface positioned between the divider and the front aperture, the surface being treated to diffusely reflect light from the respective one of the one or more light sources out of the front aperture.

In some cases, the support linkage comprises a first linkage arm having a first end rotatably coupled to the roller housing and a second linkage arm having a first end rotatably coupled to the slidable end panel, wherein a second end of the first linkage arm is rotatably coupled to a second end of the second linkage arm by a resistance coupling, and wherein the resistance coupling provides sufficient resistance to overcome the biasing force of the roller assembly. In some cases, the support linkage is coupled between an upper region of the roller housing and an upper region of the slidable end panel, and wherein the deployable screen system further comprises a second support linkage coupled between a lower region of the roller housing and a lower region of the slidable end panel. In some cases, the screen is positioned between the support linkage and the stationary section when the door section is in the open position and the slidable end panel is in the extended position.

In some cases, the deployable screen system further comprises: an additional roller assembly positioned within the roller housing; and an additional screen having a first end supported by the slidable end panel and a second end supported by the additional roller assembly, wherein the support linkage is positioned between the screen and the additional screen. In some cases, an exposed surface of the screen faces the stationary section when the door section is in the open position and the slidable end panel is in the extended position, and wherein the exposed surface of the screen is a uniform color. In some cases, an exposed surface of the additional screen faces away from the stationary section when the door section is in the open position and the slidable end panel is in the extended position, and wherein the exposed surface of the additional screen is different from the uniform color. In some cases, the first end of the screen includes a region of increased thickness, wherein the slidable end panel includes a retention channel having a vertical slot, and wherein the first end of the screen is supported by the slidable end panel by the region of increased thickness being positioned within the retention channel as the screen passes through the vertical slot. In some cases, the roller housing is removably coupled to the door section. In some cases, the door section includes i) a shelf; ii) an additional work surface; iii) a cabinet; iv) a drawer; v) a hanger bar; or vi) any combination of i-v.

Certain aspects and features of the present disclosure include a method, comprising: providing a workstation assembly having door section rotatably coupled to a stationary section; opening the workstation assembly by rotating the door section away from the stationary section; and extending a deployable screen by pulling a slidable end panel away from the door section, wherein pulling the slidable end panel away from the door section causes the deployable screen to unwrap from a roller assembly coupled to the door section.

In some cases, the method further comprises: removing the deployable screen, wherein removing the deployable screen includes uncoupling the roller assembly from the door section; attaching an alternate deployable screen, wherein attaching the alternate deployable screen includes coupling an alternate roller assembly to the door section; and extending the alternate deployable screen, wherein extending the alternate deployable screen includes pulling the slidable end panel away from the door section, wherein pulling the slidable end panel away from the door section causes the alternate deployable screen to unwrap from the alternate roller assembly.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
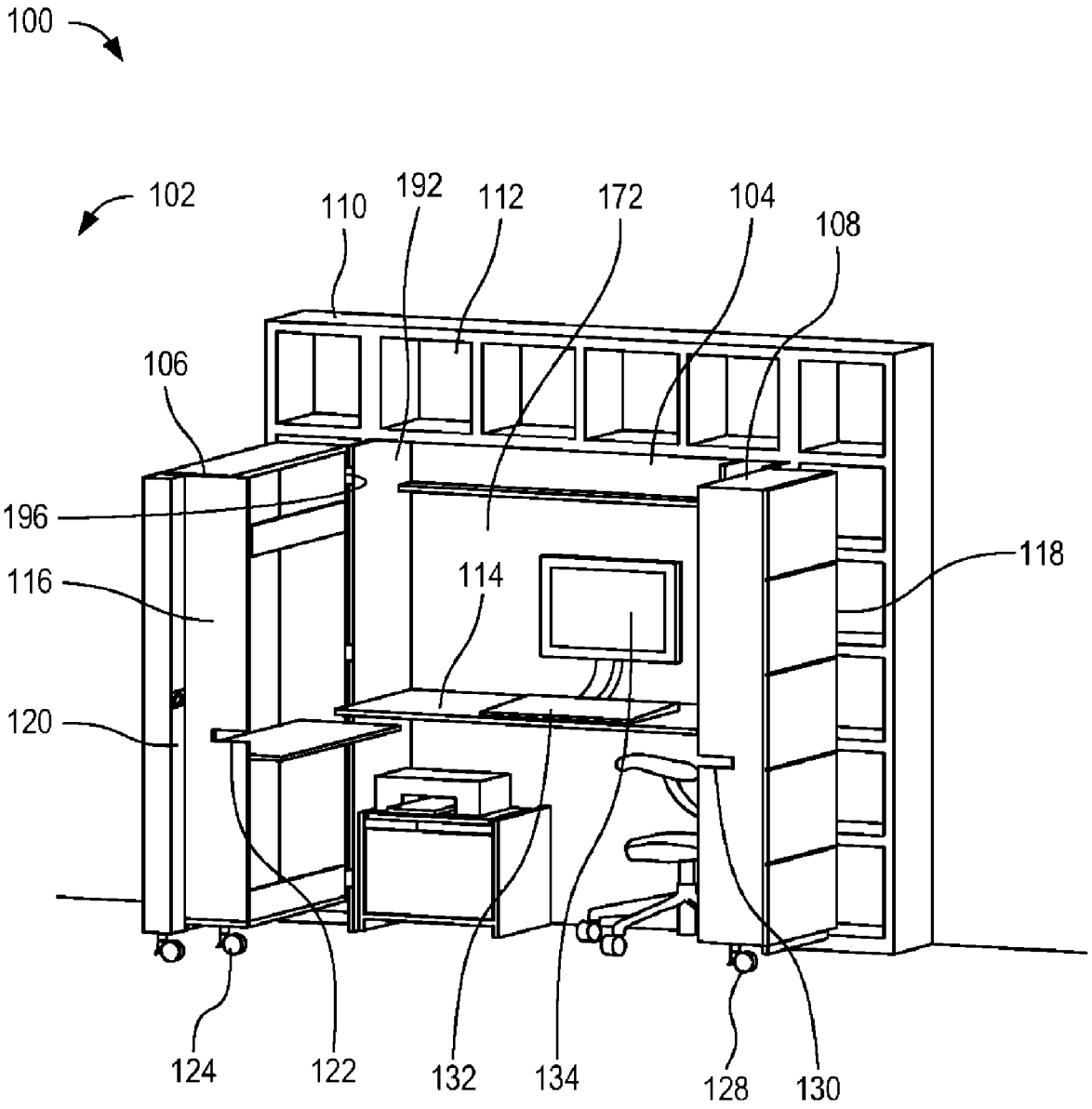
FIG. 1 is an axonometric projection of a workstation assembly with door sections in open positions, according to certain aspects of the present disclosure.

Certain aspects and features of the present disclosure relate to a workstation assembly that can be opened when needed. When closed, the workstation assembly can be aesthetically pleasing and can have a reduced footprint. When opened, the workstation assembly can include a deployable screen system capable of deploying an interior screen from a door section of the workstation assembly. The screen can provide a backdrop for videoconferencing, can provide improved isolation (e.g., sound isolation, visual isolation, shared airflow isolation, and the like) for an individual within the opened workstation assembly. The deployable screen system can also include an exterior screen for providing an aesthetically pleasing exterior and improved isolation while the workstation assembly is in use. The workstation assembly can also include a surround frame with openings and light sources to provide diffuse illumination to the environment surrounding the workstation assembly, which can be especially useful when natural light is unavailable.

The workstation assembly can include a stationary section and one or more door sections. In some cases, the workstation assembly includes two doors: a left door and a right door. In such cases, the one door may be wider than the other door (e.g., the left door being wider than the right door as depicted in the figures below), although that need not always be the case. Each door section can be rotatably coupled to a side panel of the stationary section, such as by one or more hinges. Each door section can thus rotate from a closed position to an open position. In the closed position, the door section at least partially occludes the stationary section. In the open position, the door section is rotated away from the stationary section to permit access to the stationary section. In some cases, a stopper can be used to halt rotation of the door section past the open position, although that need not always be the case. In some cases, the open position is a position 90° rotated from the closed position, although that need not always be the case. In some cases, the angle of rotation between the closed position and the open position is within 1°, 2°, 3°, 4°, 5°, 6°, 7°, 8°, 9°, 10°, 11°, 12°, 13°, 14°, and/or 15° from 90° and/or from 180°. Other ranges can be used.

The stationary section can include a rear wall panel and two side panels. The stationary section can include a work surface, such as a desk, as well as any other suitable workspace features, such as a shelf (e.g., a stationary shelf, such as a bookshelf, and/or a slide-out shelf, such as a printer slide-out shelf); an additional work surface; a cabinet (e.g., a hanging file cabinet); a drawer; a hanger bar (e.g., to hang clothes); or any combination thereof.

In some cases, the stationary section can be configured to support a display (e.g., a discrete computer monitor or a display of a computing device, such as a laptop computer or tablet computer) and/or input devices on, above, and/or below the work surface. For example, the stationary section can include channels, electrical outlets, holes, and the like to facilitate placement of a display and/or input devices on the work surface of the stationary section. In some cases, the stationary section can include one or more movable computer equipment supports. Such a movable computer equipment support can be capable of supporting any suitable computer equipment, such as an input device, a display, a computer housing, or the like. In an example, an extendable keyboard tray can be coupled to an underside of the work surface. In another example, a movable support arm can be coupled to the stationary section (e.g., at the rear wall panel, a side panel, the work surface, or elsewhere) to support a display and/or one or more input devices (e.g., a keyboard, a mouse, a touchpad, a touchscreen monitor, and the like).

A movable computer equipment support can move between an extended position and a retracted position. In the extended position, the movable computer equipment support can allow for any computer equipment supported thereon to be positioned in a convenient location for use (e.g., standing use and/or seated use) by a user of the workstation assembly. For example, if the movable computer equipment support is a keyboard tray, the keyboard tray may be extended to allow access to the keyboard thereon. In the retracted position, the movable computer equipment support can be retracted towards the rear wall panel such that the movable computer equipment support or the computer equipment support thereon does not hinder closing of any door sections of the workstation assembly. In some cases, movement of the movable computer equipment support can be automatically controlled in a retracting and/or extending direction. Such automatic control can be accomplished via electronic (e.g., via actuators) or mechanical (e.g., via linkages or contacting surfaces) techniques. In some cases, opening of one or more door sections can automatically cause the movable computer equipment support to move towards the extended position. In some cases, closing of one or more door sections can automatically cause the movable computer equipment support to move towards the retracted position.

While the work surface may be positioned between the first side wall and the second side wall, it may not always extend for that full width. In some cases, the work surface of the stationary section can extend between a first side wall and a supplemental barrier that is spaced apart from the second side wall. The space between the supplemental barrier and the second side wall can be used to fit equipment within the workstation assembly while the one or more door sections are closed. For example, a desk chair (e.g., a rolling desk chair) may include a back support that extends above the ground to a height greater than the height of the work surface above the ground. Thus, to store the desk chair within the workstation assembly, the desk chair can be maneuvered so that the back support fits within the space between the supplemental barrier and the second side wall. Other items can be stored in such a space, such as clothing, equipment, and the like.

Each door section of the workplace assembly can include a frame. The frame can include an exterior wall, a proximal side wall coupled to the stationary section, and a distal side wall opposite the proximal side wall. In some cases, the frame can include one or both of a top panel and a bottom panel. The door section can include any number and combination of workspace features, which can be located between the proximal side wall and the distal side wall, although that need not always be the case. Examples of such workspace features can include a work surface (e.g., an additional work surface positioned in a plane above or below the plane of the work surface of the stationary section), a shelf; an additional work surface; a cabinet; a drawer; a hanger bar (e.g., to hang clothes); or any combination thereof. In some cases, the distal side wall can include a slot, split, or other opening for accepting the work surface of the stationary section when the door section is in a closed position. In some cases, each door section can be supported above the floor by a translational mechanism, such as one or more casters or other rollers. In other cases, each door section can be supported through the rotational coupling with the stationary section, and can optionally include one or more deployable supports that can be deployed to provide additional support when the door section is in a closed position and/or an open position.

One of the door sections can include a deployable screen system. In some cases, multiple door sections can include distinct deployable screen systems. The deployable screen system can be built into the door section, although that need not always be the case. For example, in some cases, a deployable screen system, or at least a portion of the deployable screen system, can be provided as a removable cassette that can be placed into a corresponding receiving space of the door section to couple the deployable screen system to the door section.

The deployable screen system can include a roller housing coupled to the door section. In some cases, the roller housing can be coupled to the door section via removable coupling mechanisms. In some cases, the roller housing can be more permanently coupled to the door section, such as through more permanent coupling mechanisms or by being formed of elements of the door section (e.g., the exterior wall, the distal side wall, and an additional wall). In such cases, the roller housing may act as a receiving space for receiving other portions of the deployable screen system.

The deployable screen system can include at least one roller positioned within the roller housing. A screen can be wrapped around the roller. A biasing device (e.g., an internal spring) of the roller can apply a biasing force to wrap the screen around the roller. Thus, pulling the screen off of the roller (e.g., unwrapping the screen) can require applying sufficient force to overcome the biasing force. Additionally, a threshold resistance exists that can be applied to an unwrapped screen to prevent the biasing force from overcoming the threshold resistance without user intervention.

The screen can be coupled to the roller at a first end (e.g., a proximal end), such as through a coupling device (e.g., clamp, adhesive, staples), through friction (e.g., friction from several wraps of the screen around the roller), or in other fashions. An opposite, second end of the screen (e.g., a distal end) can be coupled to a slidable end panel through any suitable fashion. In some cases, the distal end of the screen can include a region of increased thickness (e.g., from folding over the screen to create a seam), which can be slid into a retention channel of the slidable end panel. The retention channel can have a slot large enough to permit passage of a nominal thickness of the screen, but not large enough to permit passage of the region of increased thickness of the screen, thus retaining the distal end of the screen and effectively coupling the distal end of the screen to the slidable end panel.

The slidable end panel can be a panel that has a height at least as tall as a width of the screen. In some cases, the slidable end panel is designed to match the finishing of the door section. The slidable end panel can be supported on one or more translational mechanisms, such as one or more casters, thus permitting the slidable end panel to slide away from the door section. In some cases, the slidable end panel includes a handle to facilitate sliding of the slidable end panel, although that need not always be the case. The slidable end panel can move between a retracted position and an extended position. In the retracted position, the slidable end panel is positioned near the roller housing and the screen is substantially wrapped around the roller (e.g., at least 99%, 95%, 90%, 85%, 80%, 75%, and/or 70% of the length of the screen is wrapped around the roller). In the extended position, the slidable end panel is spaced apart from the roller housing and at least a portion of the screen is unwrapped from the roller with respect to when the slidable end panel is in the retracted position.

The slidable end panel can be slidably coupled to the door section (e.g., via the roller housing) by any suitable mechanism, such as a linear actuator (e.g., a rigid chain actuator) or a support linkage. This coupling (e.g., support linkage) can provide sufficient resistance to overcome the biasing force of the roller such that the screen does wrap around the roller without the application of additional force. For example, a support linkage can include two bars rotatably coupled together, each being rotatably coupled to respective ones of to the slidable end panel and the roller housing. The rotatable coupling between the two bars can be a resistance coupling capable of providing an amount of resistance to movement necessary to overcome the biasing force of the roller. In some cases, two support linkages can be used, one coupling an upper portion of the roller housing with an upper portion of the slidable end panel, and the other coupling a lower portion of the roller housing with a lower portion of the slidable end panel.

In some cases, the deployable screen system can include two screens: an inner screen and an exterior screen. In such cases, each screen can be secured to and wrappable about its own roller. An inner screen can have an exposed surface that faces towards the stationary section of the workstation assembly. An outer screen can have an exposed surface that faces away from the stationary section of the workstation assembly. The inner screen can be located opposite the support linkage(s) from the outer screen.

A screen can be made of any suitable material, such as an antimicrobial fabric or a bleachable fabric. In some cases, the screen can be made of a material suitable to reduce airflow through the screen by at or at least 50%, 55%, 60%, 65%, 70%, 75%, 80%, 85%, 90%, 95%, 96%, 97%, 98%, 99%, and/or 100%. The exposed surface of the screen can present in any suitable fashion, such as presenting a pattern, an image, or a uniform color. For example, a screen presenting a pattern (e.g., similar to wood grain) may be useful on the exterior screen to achieve a desired aesthetic. In another example, a screen presenting a uniform color, such as white, green, or blue, may be especially useful as an interior screen to achieve a clean visual image and/or improved background removal/replacement for individuals using video cameras while within the workstation assembly. In such an example, an individual using videoconference software to make a videoconference connection may wish to have a clean background of a uniform color. Thus, with a camera positioned at the stationary section (e.g., built into or placed on top of a display) and the user sitting inside the workstation assembly (e.g., in front of the camera), the exposed surface of the interior screen would be visible behind the user from the camera's point of view.

In some cases, one or more light sources can be positioned to illuminate a user within the workstation assembly, such as when the user is joining a videoconference. In some cases, one or more additional light sources can be positioned to illuminate the inner screen. Such light sources and additional light sources can be manually controlled or automatically controlled.

In some cases, the rear wall panel of the stationary unit or a portion of the rear wall panel of the stationary unit (e.g., a portion of the rear wall panel bounded by the work surface, the ceiling panel of the stationary unit, a side panel of the stationary unit, and a supplemental panel of the stationary unit or opposite side panel of the stationary unit) can output light. For example, the rear wall panel or portion thereof can be made of a transparent or translucent material capable of passing light therethrough, preferably diffuse light. Such a rear wall panel or portion thereof can be backlit or edge-lit by an additional light source. In some cases, the rear wall panel or a portion thereof can be front-lit and can have a diffusely-reflective surface designed to diffusely reflect light from an additional light source.

In some cases, one or more sensors associated with the deployable screen system can be used to trigger actions when the screen is in a retracted position, in an extended position, and/or moving between the retracted position and the extended position. Any suitable sensors can be used. In some cases, a sensor can be associated with the roller, the screen, the slidable end panel, and/or the support linkage. For example, a hall sensor coupled adjacent the roller can record the number of times a magnet coupled to the roller passes by, thus permitting the sensor to know how much the screen is wound on or unwound from the roller. In another example, a mechanical lever switch can be coupled adjacent an arm of a support linkage such that it becomes depressed when the slidable end panel is moved to the retracted position or the extended position.

Such sensors can be used to activate additional functionality of the workstation assembly or can be used to transmit a signal to a computer located within the workstation assembly. In an example, triggering of a sensor associated with full deployment of the screen (e.g., movement of the slidable end panel to the extended position) can cause additional light sources that illuminate the screen to automatically turn on. In another example, movement of the screen away from a fully deployed position can cause a signal to be sent to the computer to automatically lock the computer or perform another security-related action. Thus, if a screen that would otherwise visually occlude the computer's display is pushed closed, the signal can automatically lock the computer confidential information is not leaked when the screen no longer visually occludes the computer's display. In some cases, signals from such sensors can be used to automatically extend and/or retract the movable computer equipment support.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is an axonometric projection of a workstation assembly 100 with door sections 106, 108 in open positions, according to certain aspects of the present disclosure. The workstation assembly 100 can be located within an environment 102, such as an office of a building, an open-office-floorplan floor of an office building, a room in a residence, or any other suitable location. In some cases, environment 102 is a common space with multiple individuals all working in the common space. In some cases, environment 102 is a multi-use space for which the workstation assembly 100 is only used for a portion of a time period. In some cases, the environment 102 can have little or no natural light, such as a windowless room or a region of a floor spaced far apart from windows.

The workstation assembly 100 can include a stationary section 104 with a work surface 114. A movable computer equipment support, such as a keyboard tray 132 and/or a display arm 134 can be coupled to the stationary section 104 via the work surface 114, a rear wall panel 172, or otherwise.

In some cases, rear wall panel 172 itself or a portion thereof (e.g., a portion defined by the first side panel 192, an opposite supplemental panel (e.g., supplemental panel 896 of FIG. 8), the work surface 114, and a ceiling panel 198) can transmit or reflect diffuse light. In an example of transmitting diffuse light, the rear wall panel 172 or portion thereof can be made of a transparent or translucent material, which can be backlit or edge-lit by a light source to transmit diffuse light. In an example of reflecting diffuse light, the rear wall panel 172 or portion thereof can be front-lit by a light source and can have a surface capable of diffusely reflecting light from the light source. In some cases, light coming from the rear wall panel 172 (e.g., via transmission or reflection) can be controlled manually (e.g., via a button or switch) or automatically (e.g., automatically in response to rotating one or both door sections 106, 108 by a threshold degree of rotation).

A first door section 106 can be rotatably coupled to a first side panel 192 of the stationary section 104 by hinges 196. In an open position, the first door section 106 can form a 90° or approximately 90° angle with the stationary section 104, although that need not always be the case. The first door section 106 includes a distal side wall 116 with a slot 122 shaped to fit around the work surface 114 when the first door section 106 is in a closed position. The first door section 106 is supported over the floor by a caster 124, permitting the first door section 106 to rotate between the closed position and open position. The first door section 106 further includes a deployable screen system 120 coupled thereto (e.g., integrated therein or removably coupled thereto).

A second door section 108 can be rotatably coupled to a second side panel of the stationary section 104 by hinges. The second side panel is located opposite the work surface 114 from the first side panel 192. In an open position, the second door section 108 can form a 90° or approximately 90° angle with the stationary section 108, although that need not always be the case. The second door section 108 can include a distal wall 118 with a slot 130 shaped to fit around the work surface 114 when the second door section 108 is in a closed position. The second door section 108 can be supported over the floor by a caster 128, permitting the second door section 108 to rotate between the closed position and open position.

The workstation assembly 100 depicted in FIG. 1 includes a surround frame 110 containing a number of openings 112 (e.g., sixteen openings). One or more light sources associated with the openings 112 can cause illumination to exit from the surround frame 110 and illuminate the environment 102. The use of the surround frame 110 with openings 112 can permit diffuse light to illuminate the environment 102, which can be beneficial to working in the workstation assembly 100, especially if the environment 102 has little or no natural light.

Figure 2:
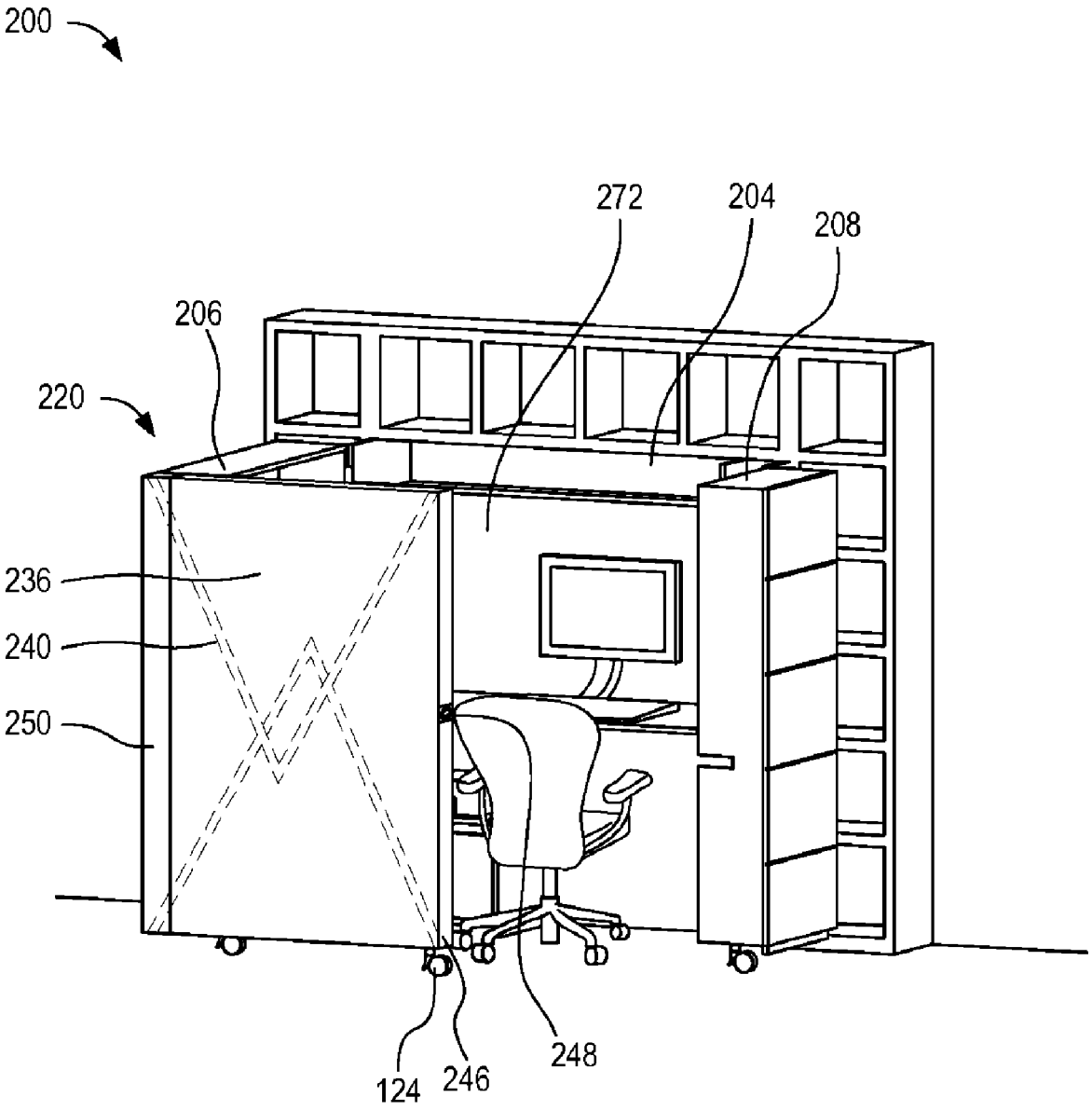
FIG. 2 is an axonometric projection of a workstation assembly with a deployable screen partially deployed, according to certain aspects of the present disclosure.

FIG. 2 is an axonometric projection of a workstation assembly 200 with a deployable screen 236 partially deployed, according to certain aspects of the present disclosure. Workstation assembly 200 can be workstation assembly 100 of FIG. 1 after partial deployment of screen 236.

Screen 236 is a part of the deployable screen system 220, which is positioned at a distal end of the first door section 206. The deployable screen system 220 includes a slidable end panel 246 that is supported over the floor by a caster 226. The slidable end panel 246 can be coupled to a roller housing 250 such that the slidable end panel 246 can move between a retracted position and an extended position. In the retracted position, the slidable end panel 246 is located adjacent to or within the roller housing 250. In the extended position, the slidable end panel 246 is located spaced apart from the roller housing 250. Moving the slidable end panel 246 between the retracted position and the extended position can involve sliding the slidable end panel 246 along a direction that is parallel to the floor and parallel to the stationary section 204 (e.g., the rear wall panel of the stationary section 204). In some cases, the slidable end panel 246 can include a handle 248 to facilitate moving the slidable end panel 246.

The slidable end panel 246 can be coupled to the roller housing 250 by an opposing pair of support linkages 240 (e.g., an upward-facing "V" shaped linkage and a downward-facing "V" shaped linkage as depicted in FIG. 2), although that need not always be the case.

The screen 236 can be coupled to a roller within roller housing 250 at a first end and to the slidable end panel 246 at an opposite, second end. Roller housing 250 can be part of or can be otherwise coupled to the first door section 206. When it is being deployed, screen 236 can be parallel or approximately parallel to the stationary section 204 (e.g., the rear wall panel of the stationary section 204).

Figure 3:
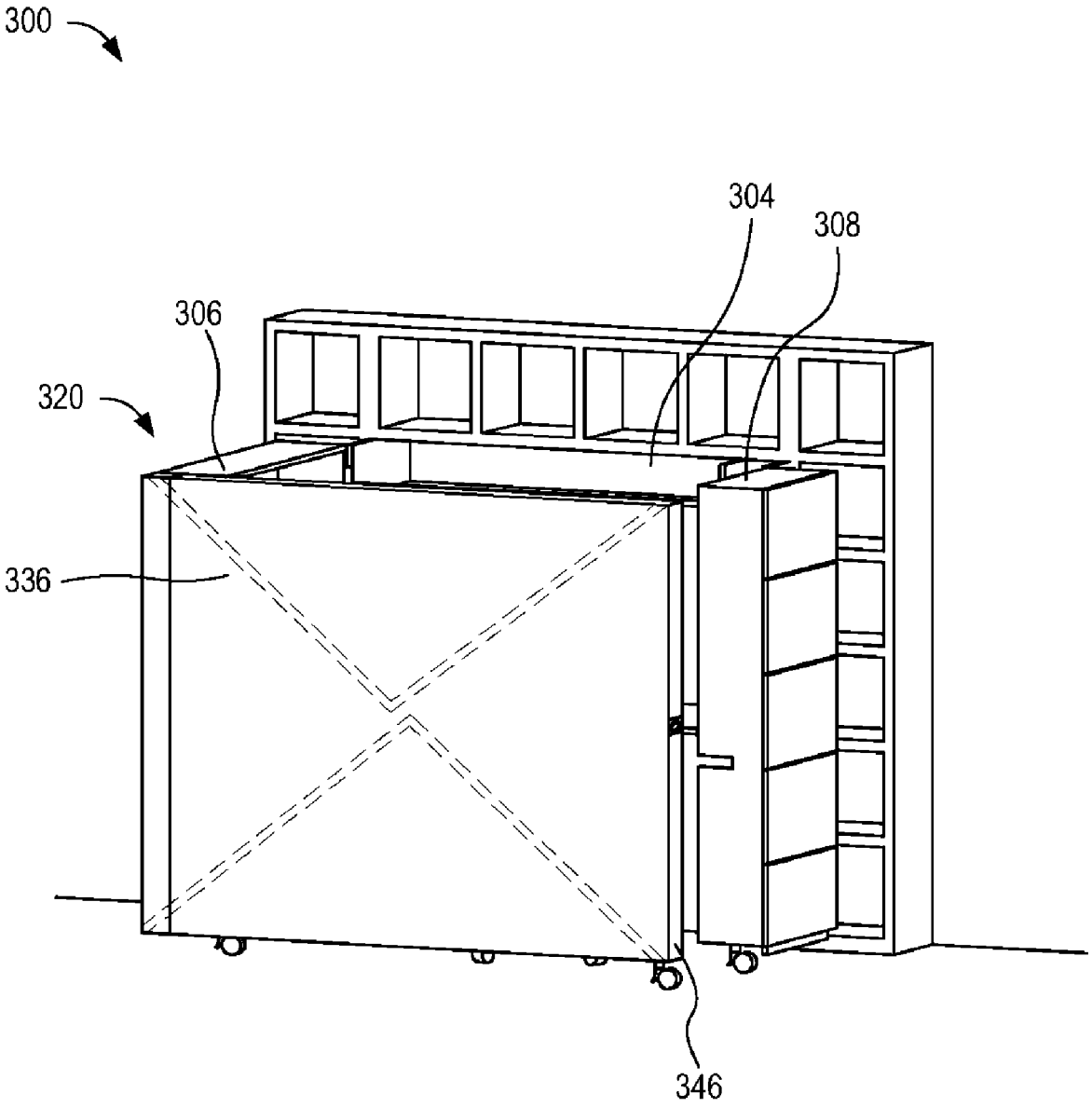
FIG. 3 is an axonometric projection of a workstation assembly with a deployable screen fully deployed, according to certain aspects of the present disclosure.

FIG. 3 is an axonometric projection of a workstation assembly 300 with a deployable screen 336 fully deployed, according to certain aspects of the present disclosure. Workstation assembly 300 can be workstation assembly 200 of FIG. 2 after full deployment of screen 336.

The screen 336 of the deployable screen system 320 is in a fully deployed position, with the slidable end panel 346 in its extended position. In the extended position, the slidable end panel 346 can be located adjacent the second door section 308. In some cases, a plane formed by the slidable end panel 346 can pass through and/or beyond the second door section 308 when the slidable end panel 346 is in the extended position, although that need not always be the case.

In the fully deployed position, screen 336 can create a barrier between the environment in which the workspace assembly 300 is positioned and the an interior of the workspace assembly 300 (e.g., an interior region defined by the stationary section 304, the first door section 306, the second door section 308, and the screen 336).

In some optional cases, the slidable end panel 346 can removably couple to the second door section 308, such as via a latch or other suitable mechanism. Such removable coupling of the slidable end panel 346 and the second door section 308 can temporarily secure the deployable screen system 320 in the fully deployed position, such as to avoid accidental or intentional retraction by someone other than the user (e.g., someone outside of the workstation assembly 300).

Figure 4:
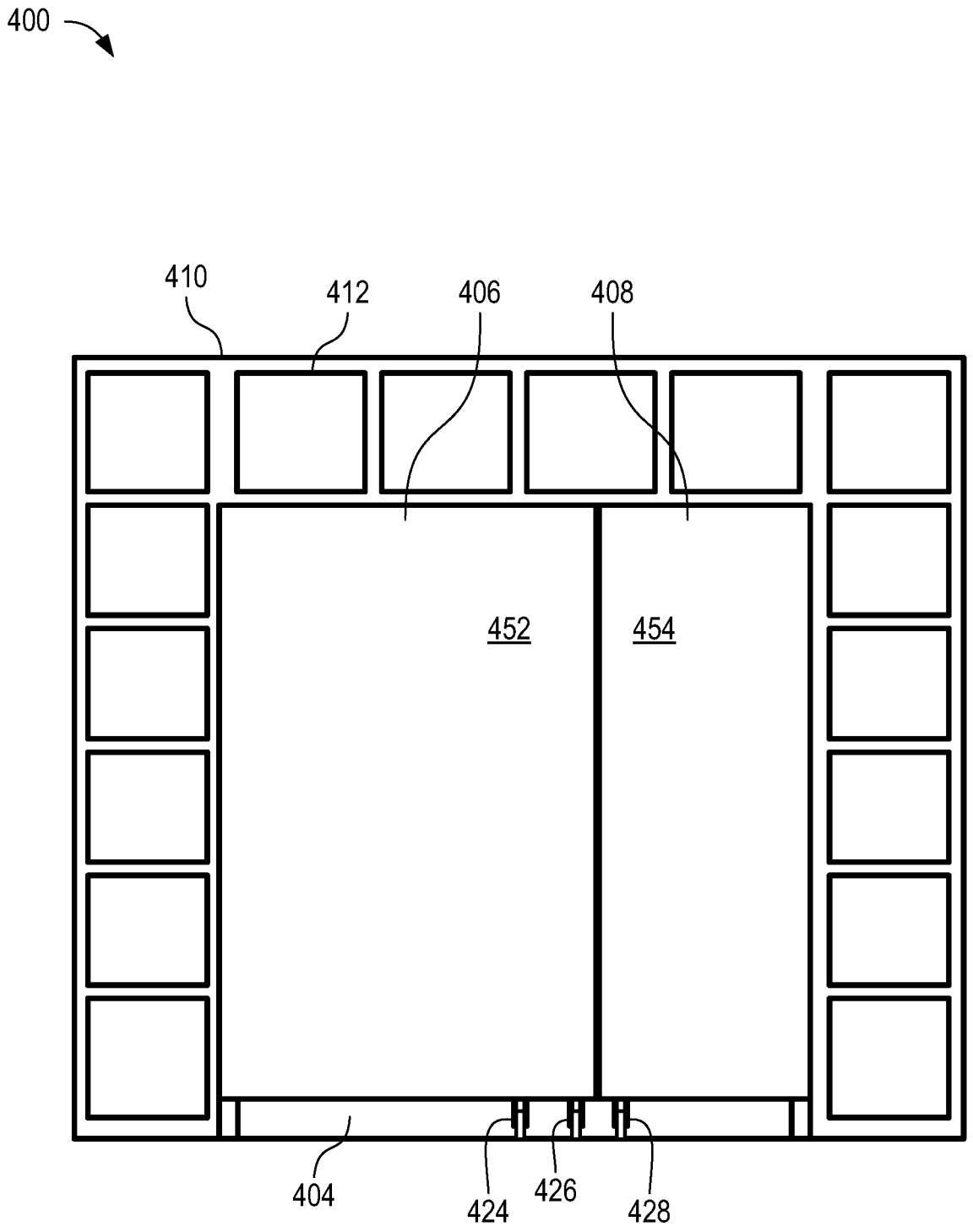
FIG. 4 is a front view of a workstation assembly with door sections in closed positions, according to certain aspects of the present disclosure.

FIG. 4 is a front view of a workstation assembly 400 with door sections 406, 408 in closed positions, according to certain aspects of the present disclosure. Workstation assembly 400 can be any suitable workstation assembly, such as workstation assembly 100 of FIG. 1.

When the door sections 406, 408 are in closed positions, the stationary section 404 can be visually occluded (e.g., substantially visually occluded). In the closed positions, door sections 406, 408 can limit access to the stationary section 404. In the closed positions, an exterior wall 452 of the first door section 406 and an exterior wall 454 of the second door section 408 can be visible. These exterior walls 452, 454 can be made of materials and/or be treated to provide an aesthetically pleasing view. For example, exterior walls 452, 454 may be made of stained wood or other materials treated to present a desirable visual aesthetic. As depicted in FIG. 4, first door section 406 is wider than second door section 454, although that need not always be the case.

Visible near the bottom of the workstation assembly 400 is the caster 424 for the first door section 406, the caster 428 for the second door section 408, and the caster 426 for the slidable end panel of the deployable screen system.

A surround frame 410 is depicted. The surround frame 410 can include a number of openings 412 through which light can be transmitted. In some cases, the surround frame 410 can be made of the same material as and/or be made as a single body with at least a portion of the stationary section 404 (e.g., a rear wall panel, a ceiling, and/or one or more side panels of the stationary section), although that need not always be the case.

Figure 5:
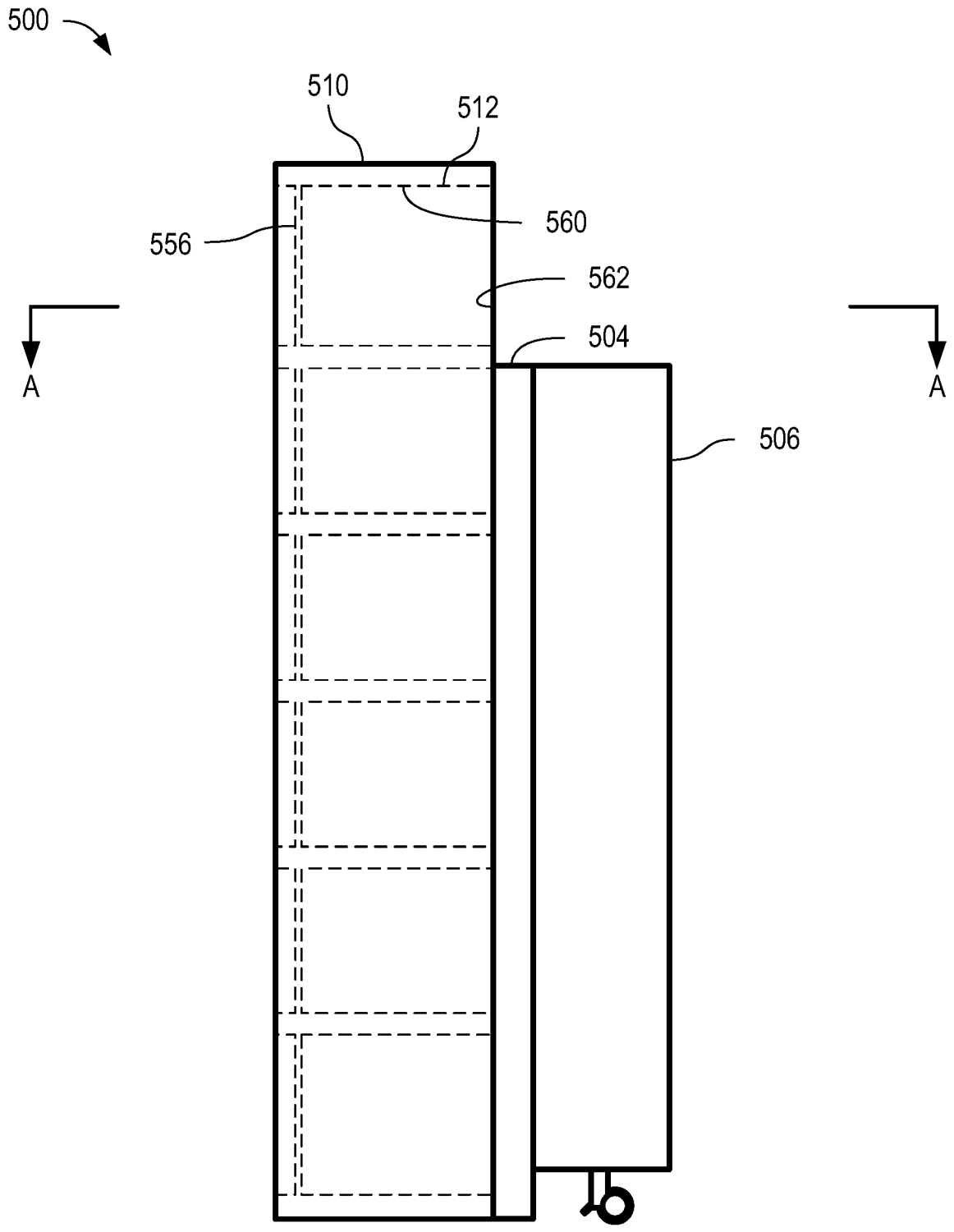
FIG. 5 is a side view of a workstation assembly with door sections in closed positions, according to certain aspects of the present disclosure.

FIG. 5 is a side view of a workstation assembly 500 with both the first door section 506 and the second door section in closed positions, according to certain aspects of the present disclosure. Workstation assembly 500 can be any suitable workstation assembly, such as workstation assembly 100 of FIG. 1. In the closed position, the first door section 506 limits access to the stationary section 504.

The surround frame 510 can include multiple openings 512. Each opening 512 can include a front aperture 562 and one or more inner surfaces 560. Each opening 512 can take any suitable cross-sectional shape (e.g., circular, square, rectangular, oval, and the like). As used herein, the term "aperture" is inclusive of an opening having any shape, such as round, rectangular, and others. As depicted herein, the cross section of each opening 512 and the opening's front aperture 562, is rectangular in shape.

Each opening 512 can include a divider 556. The divider 556 as depicted in FIG. 5 is positioned spaced apart from the front aperture 562, although that need not always be the case. Divider 556 can be positioned at the front aperture 562 in some cases. In some cases, divider 556 is positioned between a light source and the front aperture 562. Divider 556 can be transparent or translucent. Light passing through the divider 556 (e.g., from a left-to-right direction as seen in FIG. 5) can bounce off surface(s) 560, resulting in diffuse light entering the environment in front of the surround frame 510. Surface(s) 560 can be prepared to diffusely reflect light, such as by being painted white or otherwise covered in or made of a white material. Other colors and any suitable material can be used.

Figure 6:
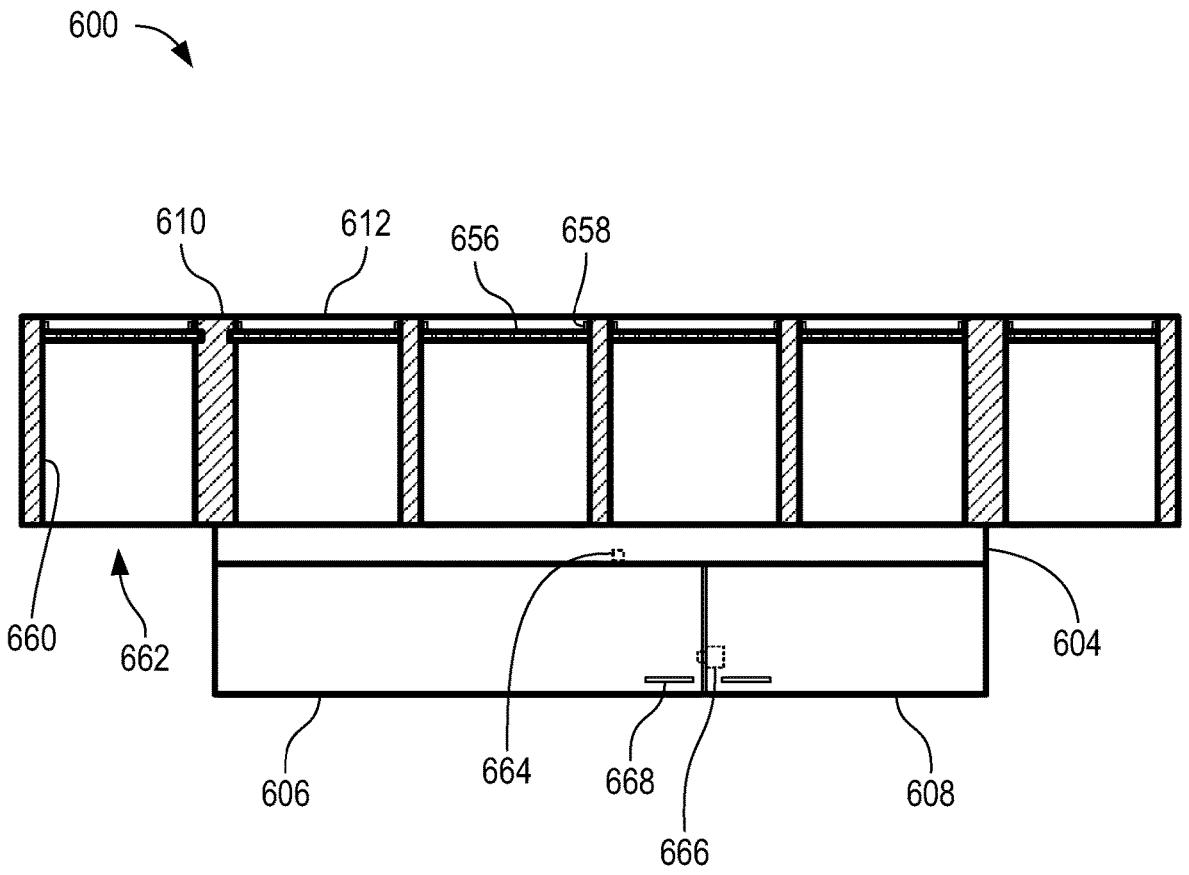
FIG. 6 is a top cutaway view of a workstation assembly with a surround frame, with door sections in closed positions, according to certain aspects of the present disclosure.

FIG. 6 is a top cutaway view of a workstation assembly 600 with a surround frame 610, with door sections 606, 608 in closed positions, according to certain aspects of the present disclosure. Workstation assembly 600 can be any suitable workstation assembly, such as workstation assembly 500 of FIG. 5. The top cutaway view of FIG. 6 is taken along line A:A of FIG. 5.

The surround frame 610 contains openings 612. Each opening 612 includes a front aperture 662 and at least one surface 660 suitable for reflecting light, such as diffusely reflecting light. Each opening 612 can also include a divider 656 made of a transparent or translucent material. The divider 656 can be positioned between the front aperture 662 and a light source 658. Light sources 658 depicted in FIG. 6 are light emitting diode (LED) strips, although any suitable light source can be used.

Door sections 606, 608 are shown in closed positions, abutting the stationary section 604. In some cases, one of the door section (e.g., first door section 606) can be removably locked in the closed position by a lock 664. Lock 664 can be any suitable mechanism for removably securing the door section to the stationary section 604, such as a latch. A second lock 666 can be used to removably lock together that door section (e.g., first door section 606) with the other door section (e.g., second door section 608). Second lock 666 can be any suitable mechanism for removably securing together the door sections 606, 608, such as a latch. While locked, the door sections 606, 608 cannot be opened. After unlocking, door sections 606, 608 can be opened, such as with the aid of handles 668.

Figure 7:
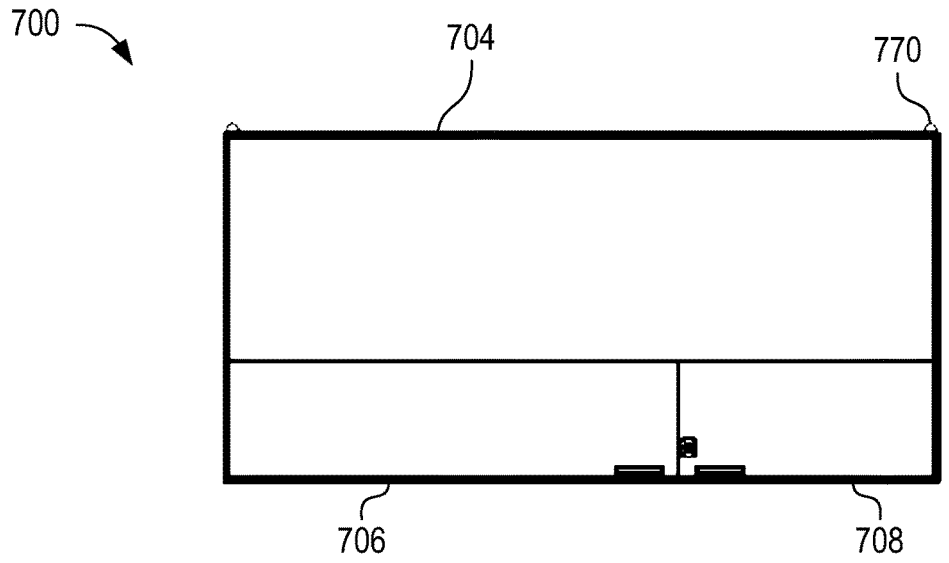
FIG. 7 is a top view of a workstation assembly without a surround frame, with door sections in closed positions, according to certain aspects of the present disclosure.

FIG. 7 is a top view of a workstation assembly 700 without a surround frame, with door sections 706, 708 in closed positions, according to certain aspects of the present disclosure. Workstation assembly 700 can be any suitable workstation assembly, such as workstation assembly 100 of FIG. 1 without a surround frame. Workstation assembly 700 includes the first door section 706 and second door section 708 in closed positions, abutting the stationary section 704. In some cases, one or more bumpers 770 can be positioned on a rear side of the stationary section 704 to improve installation of the workstation assembly 700, such as by avoiding damage to any walls or objects against which the workstation assembly 700 is placed.

Figure 8:
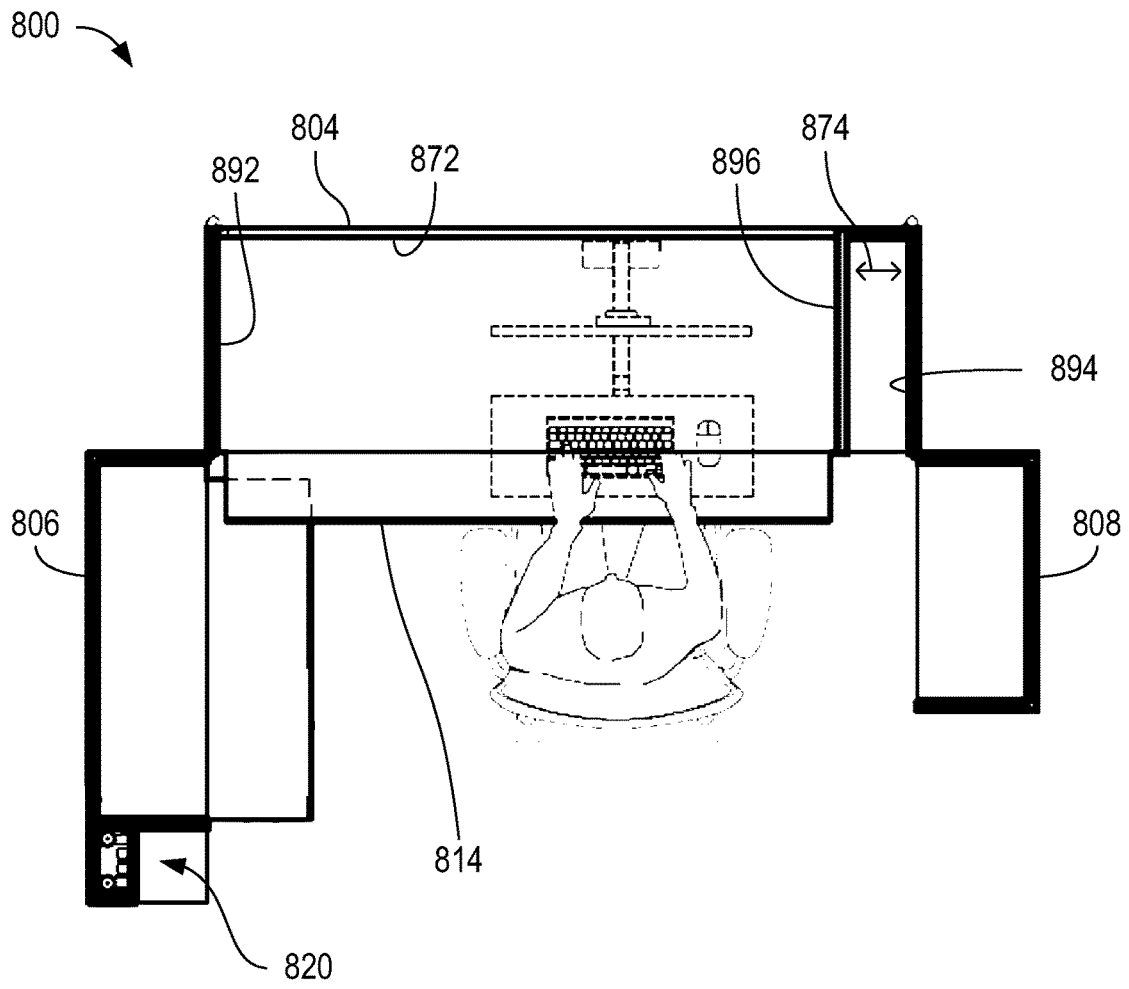
FIG. 8 is a top view of a workstation assembly without a surround frame, with door sections in open positions, according to certain aspects of the present disclosure.

FIG. 8 is a top view of a workstation assembly 800 without a surround frame, with door sections 806, 808 in open positions, according to certain aspects of the present disclosure. Workstation assembly 800 can be any suitable workstation assembly, such as workstation assembly 700 of FIG. 7 after opening the door sections 806, 808. For illustrative purposes, the tops (e.g., ceilings) of the stationary section 804, first door section 806, and second door section 808 are depicted as transparent.

The stationary section 804 can include a rear wall panel 872 separating a first side panel 892 and a second side panel 894. A work surface 814 can extend from the rear wall panel 872 for a distance greater than the widths of the first side panel 892 and/or second side panel 894. As depicted in FIG. 8, the work surface 814 extends from the first side panel 892 to a supplemental barrier 896. A space 874 is defined between the supplemental barrier 896 and the second side wall 894. Space 874 can be used to store objects in the depth of the stationary section 804 that would otherwise collide with work surface 814, such as a back support of a chair.

First door section 806 can be coupled to the first side panel 892, such as via a hinge. Second door section 808 can be coupled to the second side panel 894, such as via a hinge. The first door section 806 can include a deployable screen system 820.

Figure 9:
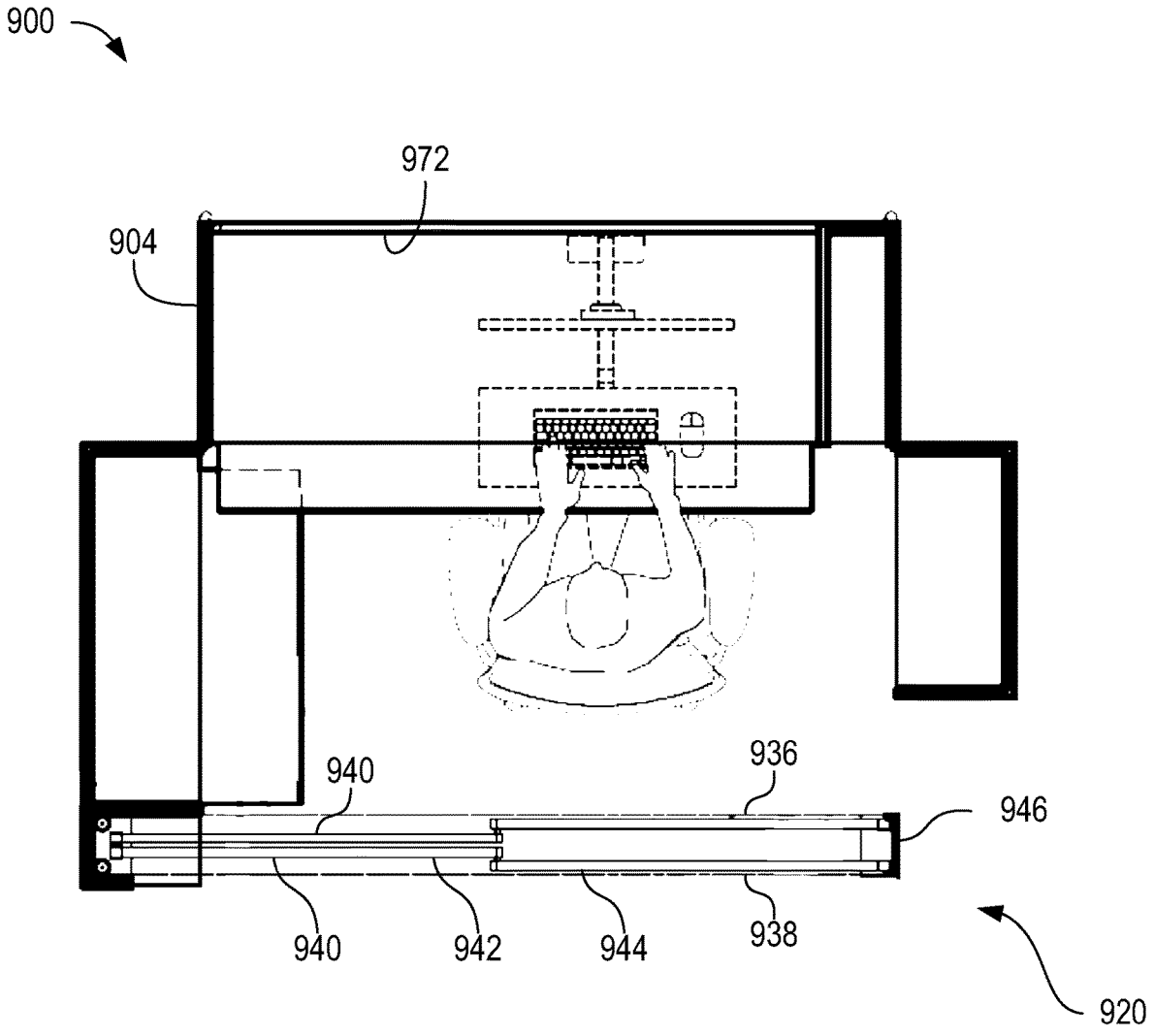
FIG. 9 is a top view of a workstation assembly without a surround frame, with deployable screens fully deployed, according to certain aspects of the present disclosure.

FIG. 9 is a top view of a workstation assembly 900 without a surround frame, with deployable screens 936, 938 fully deployed, according to certain aspects of the present disclosure. Workstation assembly 900 can be any suitable workstation assembly, such as workstation assembly 800 of FIG. 8 after deployment of screens 936, 938. For illustrative purposes, the tops (e.g., ceilings) of the stationary section 904, first door section, and second door section are depicted as transparent.

The deployable screen system 920 can have two screens, including an inner screen 936 and an outer screen 938. The screens 936, 938 are in their deployed positions, with the slidable end panel 946 in its extended position. In their deployed positions, screens 936, 938 may be in planes parallel to the rear wall panel 972 of the stationary section 904. Inner screen 936 can have an exposed surface that faces the rear wall panel 972 (e.g., towards the top of the page) and outer screen 938 can have an exposed surface that faces away from the rear wall panel 972 (e.g., towards the bottom of the page). Also depicted are two support linkages 940. Each support linkage 940 can include a first arm 942 and a second arm 944.

Figure 10:
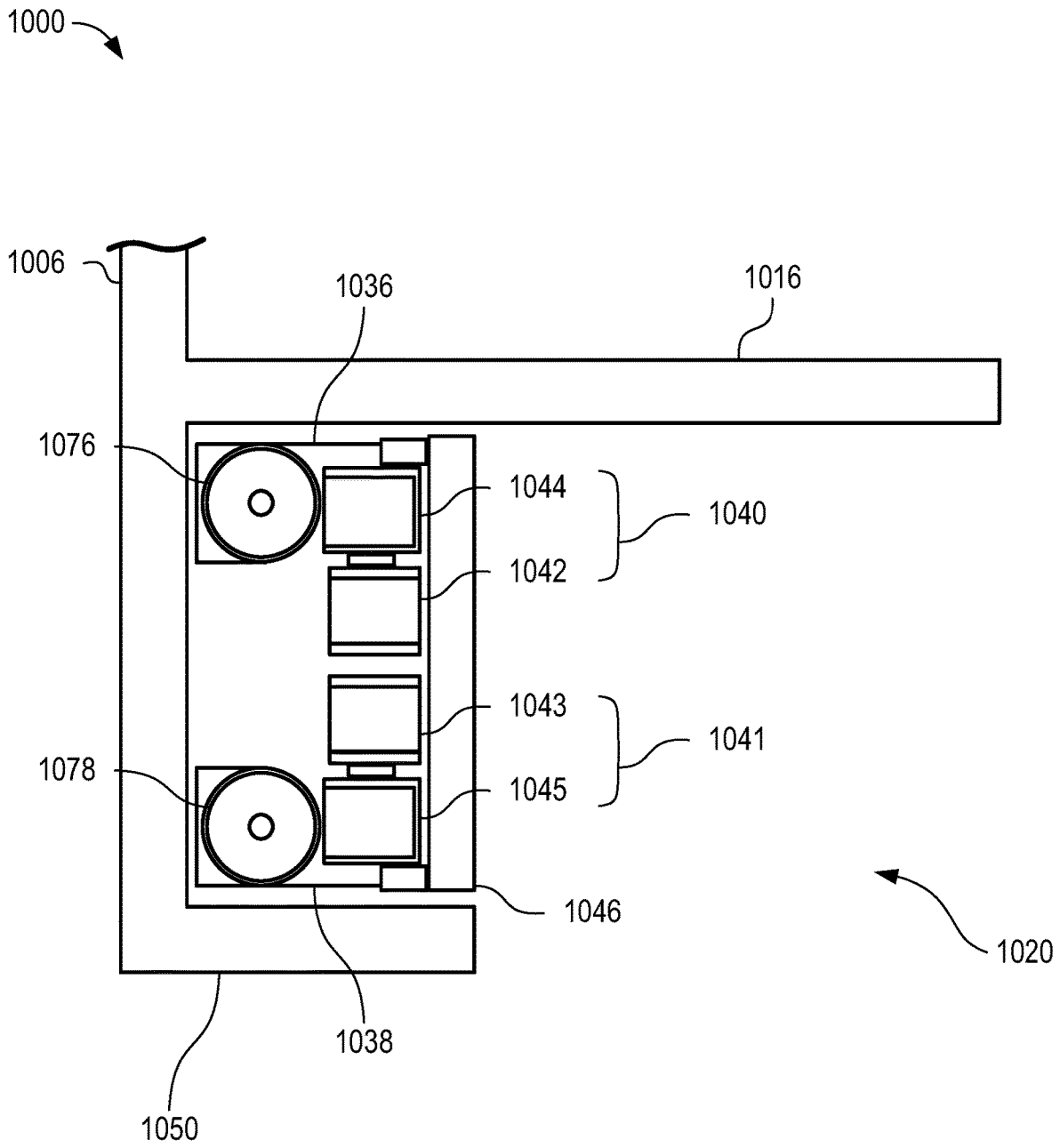
FIG. 10 is a close up view of a deployable screen system of a workstation assembly, with deployable screens in retracted positions, according to certain aspects of the present disclosure.

FIG. 10 is a close up view of a deployable screen system 1020 of a workstation assembly 1000, with deployable screens 1036, 1038 in retracted positions, according to certain aspects of the present disclosure. Workstation assembly 1000 can be any suitable workstation assembly, such as workstation assembly 100 of FIG. 1.

A deployable screen system 1020 can be coupled to the first door section 1006 at a distal end of the first door section 1006 (e.g., past distal side wall 1016). The deployable screen system 1020 can include a roller housing 1050, which is depicted as being a part of the first door section 1006, although that need not always be the case.

Inner screen 1036 is coupled between a first roller 1076 and the slidable end panel 1046. In its retracted position, inner screen 1036 is substantially wrapped around the first roller 1076. Outer screen 1038 is coupled between a second roller 1078 and the slidable end panel 1046. In its retracted position, outer screen 1038 is substantially wrapped around the second roller 1078.

The deployable screen system 1020 is shown as having two support linkages 1040, 1041. A first support linkage 1040 includes a first arm 1042 and a second arm 1044. A second support linkage 1041 includes a first arm 1043 and a second arm 1045. First arms 1042, 1043 are coupled to the roller housing 1050. Second arms 1044, 1045 are coupled to the slidable end panel 1046. The slidable end panel 1046 is in its retracted position. In the retracted position, an exterior surface of the slidable end panel 1046 may be flush with an exposed edge of the roller housing. While the slidable end panel 1046 is in a retracted position, the arms 1042, 1043, 1044, 1045 of the support linkages 1040, 1041 may be vertical or approximately vertical.

Figure 11:
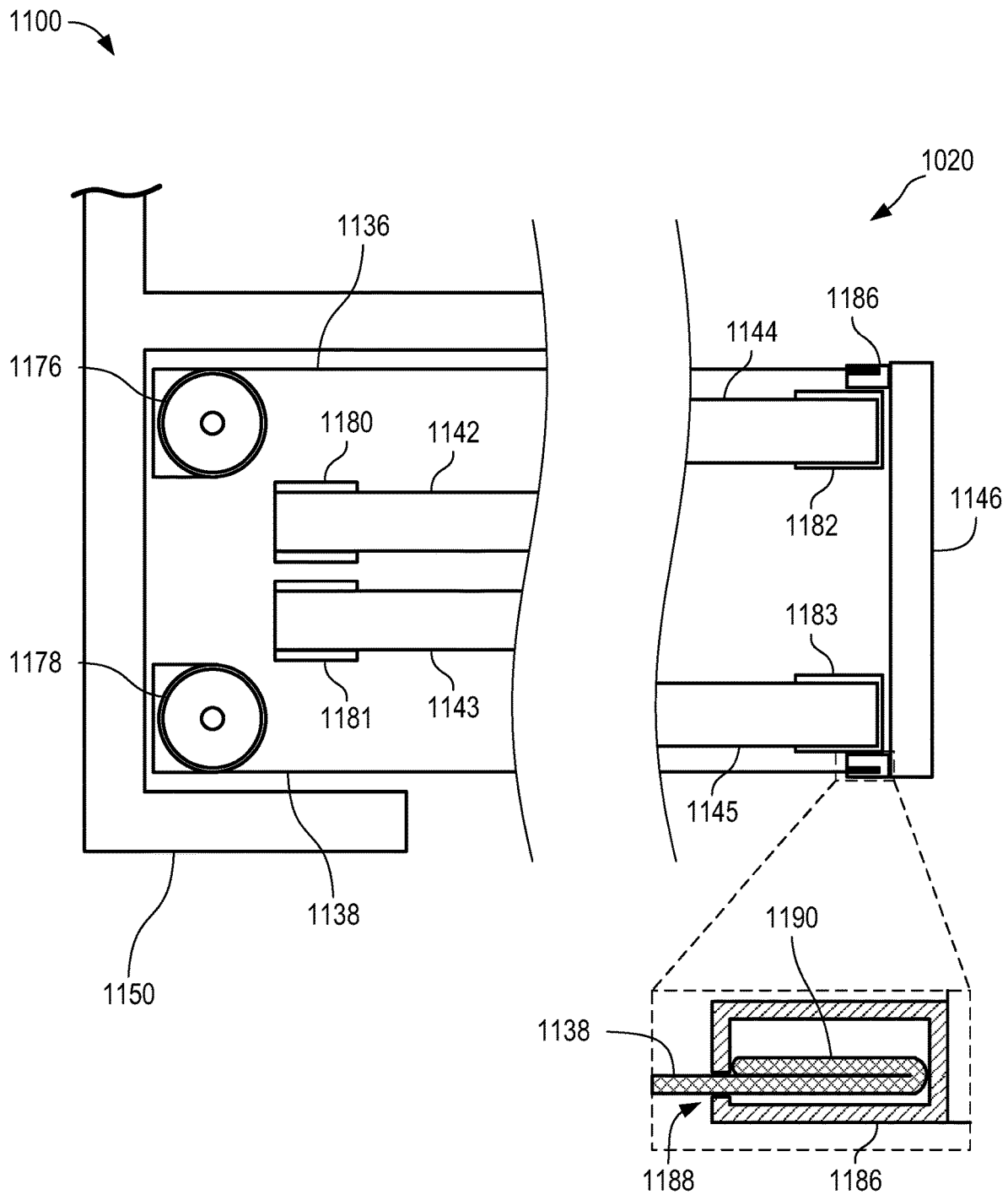
FIG. 11 is a combination close up view and enlarged view of a deployable screen system of a workstation assembly, with deployable screens in deployed positions, according to certain aspects of the present disclosure.

FIG. 11 is a combination close up view and enlarged view of a deployable screen system 1120 of a workstation assembly 1100, with deployable screens 1136, 1138 in deployed positions, according to certain aspects of the present disclosure. Workstation assembly 1100 can be any suitable workstation assembly, such as workstation assembly 1000 of FIG. 10 after deployment of the deployable screens 1136, 1138.

When the slidable end panel 1146 is in its extended position, screens 1136, 1138 are substantially unwrapped from their respective rollers 1176, 1178. When the slidable end panel 1146 is in its extended position, the arms 1142, 1143, 1144, 1145 of the support linkages may have moved away from a vertical or approximately vertical orientation. First arms 1142, 1143 can couple to roller housing 1150 by respective first pivots 1180, 1181 at first ends. Second arms 1144, 1145 can couple to the slidable end panel 1146 by respective second pivots 1182, 1183 at first ends. The second ends of the first arms 1142, 1143 can coupled to second ends of the second arms 1144, 1145 via a resistance coupling.

Each screen 1136, 1138 can be coupled to the slidable end panel 1146 by respective retention channels 1186. As depicted in further detail in the enlarged view, each retention channel 1186 can include a slot 1188. Screen 1138 can be coupled to the roller 1178 at a first end. The second end of the screen 1138 can have a region of increased thickness 1190. As depicted in FIG. 11, the region of increased thickness 1190 is a portion of the second end of the screen 1138 that has been doubled back on itself and secured in place (e.g., with adhesive or sewing). The slot 1188 of the retention channel 1186 can be sized such that a nominal thickness of the screen 1138 can fit through, but the region of increased thickness 1190 cannot. The nominal thickness of the screen 1138 can be a thickness of the screen throughout most of the screen 1138, such as before being doubled back to form the region of increased thickness 1190.

Figure 12:
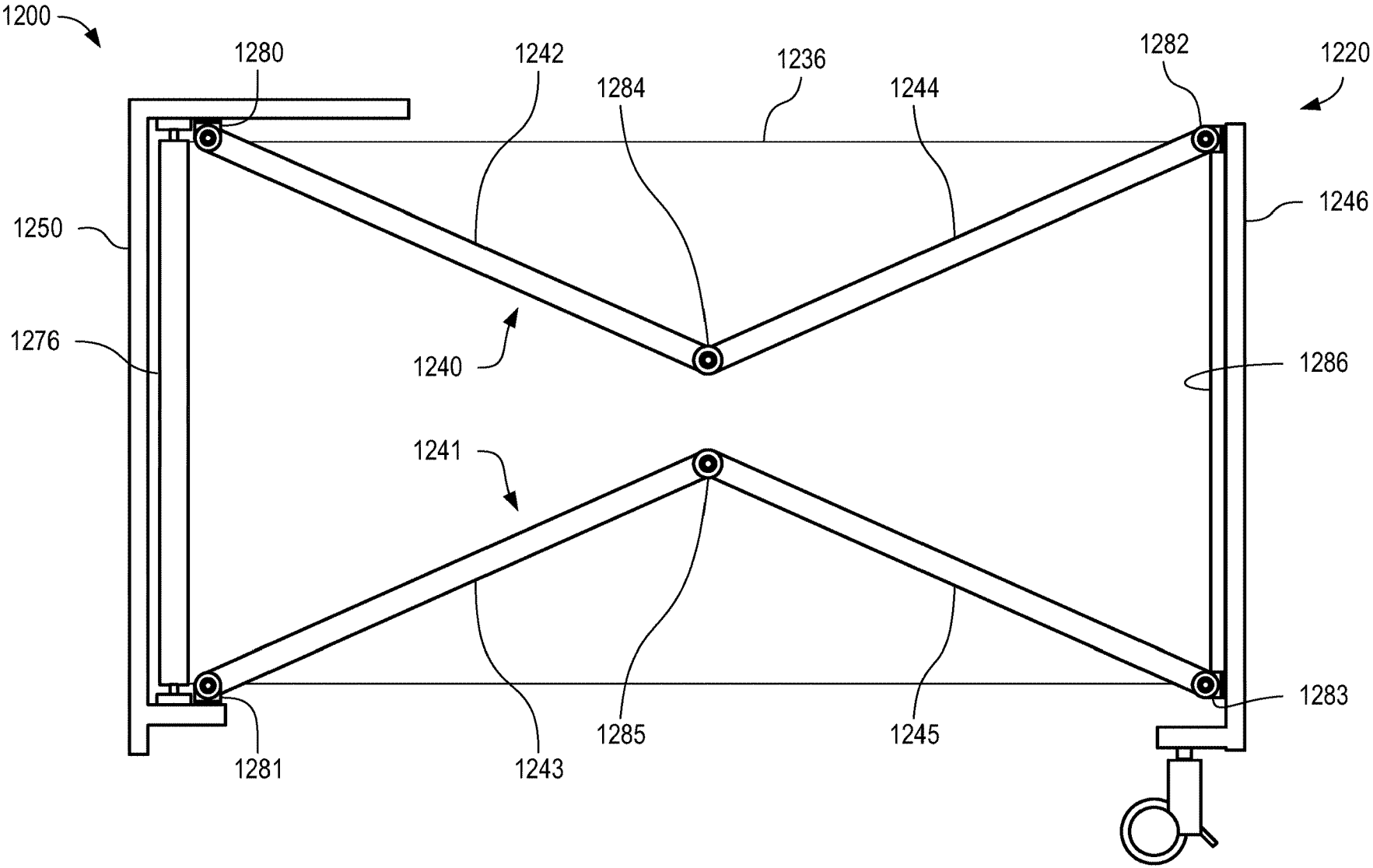
FIG. 12 is a front cutaway view of a deployable screen system of a workstation assembly, with a deployable screen in a deployed position, according to certain aspects of the present disclosure.

FIG. 12 is a front cutaway view of a deployable screen system 1220 of a workstation assembly 1200, with a deployable screen 1236 in a deployed position, according to certain aspects of the present disclosure. Workstation assembly 1200 can be any suitable workstation assembly, such as workstation assembly 100 of FIG. 1. For illustrative purposes, the cutaway view of FIG. 12 does not show any outer screen or associated roller, as well as any side wall of the roller housing 1250.

Screen 1236 is supported between roller 1276 and slidable end panel 1246. Roller 1276 provides a biasing force to pull against the screen 1236 (e.g., in a direction from right to left as seen in FIG. 12). However, resistance provided by the support linkages 1240, 1241 can overcome the biasing force such that the screen 1236 will not wrap onto the roller 1276 without additional force (e.g., from a user pushing the slidable end panel 1246 closed). Screen 1236 can be coupled to the roller 1276 at a first end and to the slidable end panel 1246 (via retention channel 1286) at a second end.

Support linkages 1240, 1241 can include respective first arms 1242, 1243 coupled to the roller housing 1250 via respective first pivots 1280, 1281. First arms 1242, 1243 can be coupled to respective second arms 1244, 1245 by respective resistance couplings 1284, 1285. Second arms 1244, 1245 can be coupled to the slidable end panel 1246 by respective pivots 1282, 1283. Each resistance coupling 1284, 1285 can be a pivot that provides an amount of resistance (e.g., via friction) to rotation of respective first arms 1242, 1243 with respect to respective second arms 1244, 1245. Thus, movement of the slidable end panel 1246 towards or away from the roller housing 1250 can only be accomplished by overcoming the resistance of the resistance couplings 1284, 1285. In some cases, an actuator can be used to adjust the resistance of resistance couplings 1284, 1285.

Figure 13:
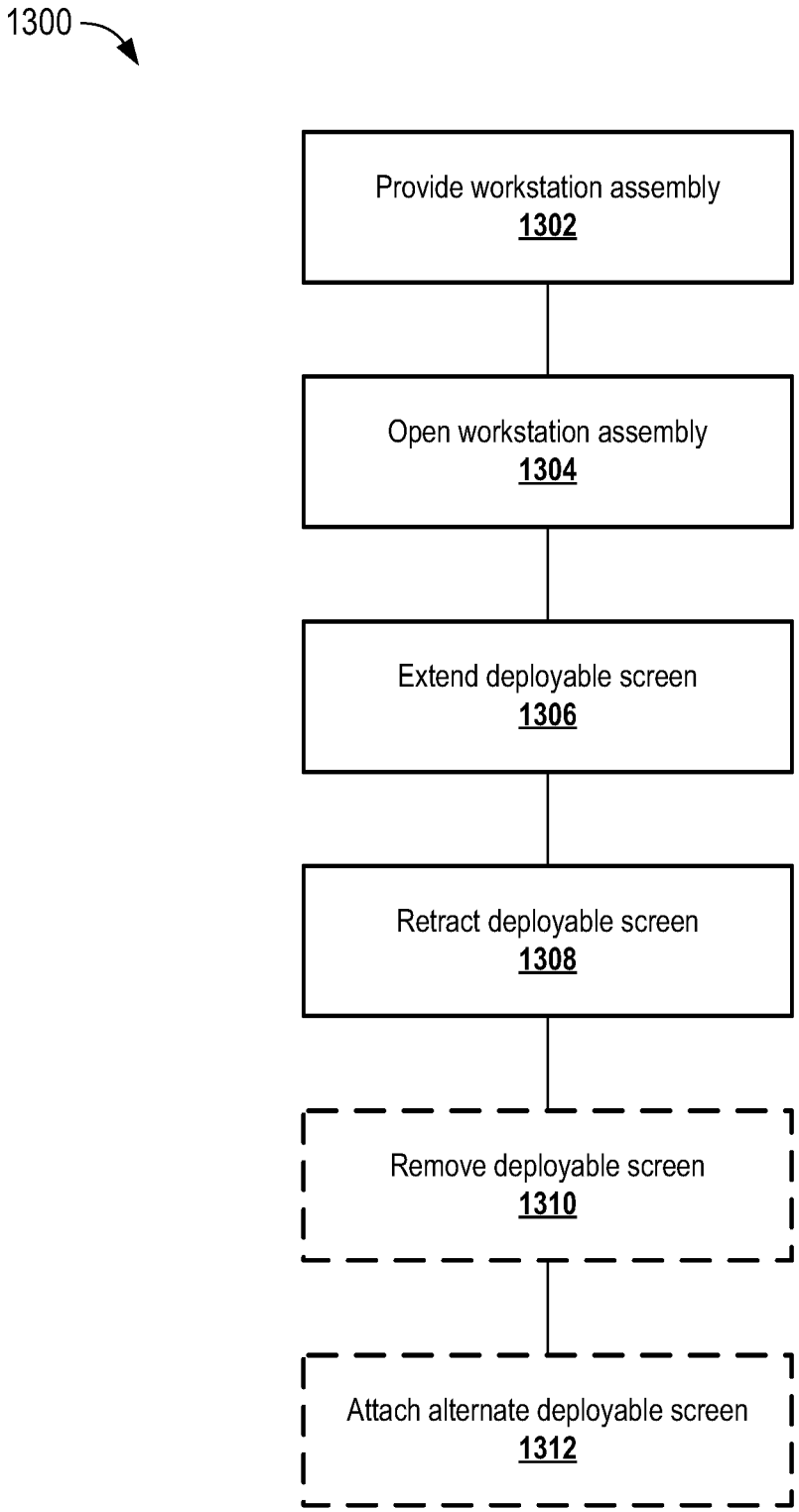
FIG. 13 is a flowchart depicting a process for using a workstation assembly, according to certain aspects of the present disclosure.

FIG. 13 is a flowchart depicting a process 1300 for using a workstation assembly, according to certain aspects of the present disclosure. Process 1300 can be carried out in any suitable environment, such as environment 102 of FIG. 1. At block 1302, a workstation assembly is provided. Providing the workstation assembly can include providing any suitable workstation assembly, such as workstation assembly 100 of FIG. 1. In some cases, providing a workstation assembly can include assembling the workstation assembly and/or maneuvering the workstation assembly into a desired location.

At block 1304, the workstation assembly is opened. Opening the workstation assembly can include moving each door section from its closed position to its open position. In some cases, opening the workstation assembly can include unlocking or unlatching each door section. In some cases, opening the workstation assembly can further include extending one or more movable computer equipment supports, such as manually or automatically in response to opening of a door section.

At block 1306, one or more deployable screens are extended. Extending a deployable screen at block 1306 can include moving a slidable end panel of a deployable screen system away from a door section (e.g., in a direction perpendicular to the door section). Moving the slidable end panel can cause the slidable end panel to move from a retracted position to an extended position. As the slidable end panel moves from the retracted position to the extended position, one or more screens coupled to the slidable end panel unwrap from respective rollers. Once the slidable end panel is in its extended position, support linkages coupling the slidable end panel to the door section can provide sufficient resistance to overcome a biasing force provided by the roller to wrap up the screen.

At block 1308, the one or more deployable screens can be retracted. Retracting a deployable screen at block 1308 can include moving a slidable end panel of a deployable screen system towards a door section (e.g., in a direction perpendicular to the door section). Moving the slidable end panel can cause the slidable end panel to move from an extended position to a retracted position. As the slidable end panel moves from the extended position to the retracted position, one or more screens coupled to the slidable end panel wrap up onto respective rollers. Moving the slidable end panel towards the retracted position can cause additional force to be applied to the support linkages to overcome the resistance of the support linkages, thus permitting the biasing force of the rollers to wrap the screens around the rollers.

In some cases, at optional block 1310, a deployable screen can be removed. Removal of the deployable screen can include removal of the screen and its associated roller. In some cases, however, removal of the deployable screen can include removal of an entire deployable screen system containing at least one or more rollers, one or more screens, a slidable end panel, and one or more support linkages. Removal of a deployable screen can include removing its associated roller and sliding the distal end of the screen out of the retention channel of the slidable end panel.

In some cases, at optional block 1312, an alternate deployable screen can be attached. Attachment of the alternate deployable screen can include attachment of the screen and its associated roller. In some cases, however, attachment of the alternate deployable screen can include attachment of an entire deployable screen system containing at least one or more rollers, one or more screens, a slidable end panel, and one or more support linkages. Attachment of an alternate deployable screen can include sliding the distal end of the screen into the retention channel of the slidable end panel and attaching its associated roller within the roller housing.

The blocks of process 1300 can be performed in any suitable order, including certain blocks being performed simultaneously or in different orders. For example, extending the deployable screen at block 1306 can occur during opening of the workstation assembly at block 1304. Additionally, while process 1300 is described with certain blocks, one, some, or all of the blocks of process 1300 can be removed and/or replaced with other blocks. Additionally, in some cases, process 1300 can include additional blocks not depicted in FIG. 13. For example, in some cases, process 1300 can include moving or positioning equipment within the workstation assembly after opening the workstation assembly at block 1304, as well as turning on one or more lights associated with a surround frame or with other aspects of the workstation assembly.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art. Numerous changes to the disclosed embodiments can be made in accordance with the disclosure herein, without departing from the spirit or scope of the present disclosure. Thus, the breadth and scope of the present disclosure should not be limited by any of the above described embodiments.

Although certain aspects of the present disclosure have been illustrated and described with respect to one or more implementations, equivalent alterations and modifications will occur or be known to others skilled in the art upon the reading and understanding of this specification and the annexed drawings. In addition, while a particular feature of the disclosure may have been disclosed with respect to only one of several implementations, such feature may be combined with one or more other features of the other implementations as may be desired and advantageous for any given or particular application.

As used below, any reference to a series of examples is to be understood as a reference to each of those examples disjunctively (e.g., "Examples 1-4" is to be understood as "Examples 1, 2, 3, or 4").

Example 1 is a workstation assembly, comprising: a stationary section having a rear wall panel, a first side panel, a second side panel, and a work surface, the work surface being positioned between the first side panel and the second side panel; a door section rotatably coupled to the stationary section at the first side panel, the door section rotatable between a closed position and an open position; and a deployable screen system coupled to the first door section, the deployable screen system comprising: a roller housing coupled to the door section; a roller assembly positioned within the roller housing and rotatable about a roller axis; a slidable end panel coupled to the roller housing by a support linkage, the slidable end panel movable between a retracted position adjacent the roller housing and an extended position spaced apart from the roller housing; and a screen having a first end supported by the slidable end panel and a second end supported by the roller assembly, the roller assembly providing a biasing force to wrap a portion of the screen about the roller assembly when the slidable end panel is in the retracted position, wherein movement of the slidable end panel to the extended position unwraps at least some of the portion of the screen from the roller assembly.

Example 2 is the workstation assembly of example(s) 1, wherein the door section is supported by a caster movable on a floor, and wherein the slidable end panel is supported by an additional caster movable on the floor.

Example 3 is the workstation assembly of example(S) 1 or 2, wherein the stationary section further includes a movable computer equipment support movable between an extended position and a retracted position, wherein movement of the door section to the closed position induces movement of the movable computer equipment support to the retracted position.

Example 4 is the workstation assembly of example(s) 1-3, further comprising an additional door section rotatably coupled to the stationary section at the second side panel, the additional door section rotatable between a closed position and an open position, wherein an inner surface of the door section faces an inner surface of the additional door section when the door section is in its open position and the additional door section is in its open position.

Example 5 is the workstation assembly of example(s) 1-4, wherein the door section has a width extending from the first side panel, wherein the additional door section has an additional width extending from the second side panel, and wherein the width of the door section is greater than the additional width of the additional door section.

Example 6 is the workstation assembly of example(s) 1-5, wherein the door section comprises an interior wall having a slot, wherein the slot of the interior wall of the door section fits around the work surface when the door section is in the closed position.

Example 7 is the workstation assembly of example(s) 1-6, further comprising a surround frame positioned around the stationary section, the surround frame having one or more light sources.

Example 8 is the workstation assembly of example(s) 7, wherein the surround frame comprises a plurality of openings, wherein each of the plurality of openings comprises: a front aperture; a respective one of the one or more light sources; and a divider separating the respective one of the one or more light sources from the front aperture, the divider being transparent or translucent Example 9 is the workstation assembly of example(s) 8, wherein each of the plurality of openings further comprises a surface positioned between the divider and the front aperture, the surface being treated to diffusely reflect light from the respective one of the one or more light sources out of the front aperture.

Example 10 is the workstation assembly of example(s) 1-9, wherein the support linkage comprises a first linkage arm having a first end rotatably coupled to the roller housing and a second linkage arm having a first end rotatably coupled to the slidable end panel, wherein a second end of the first linkage arm is rotatably coupled to a second end of the second linkage arm by a resistance coupling, and wherein the resistance coupling provides sufficient resistance to overcome the biasing force of the roller assembly.

Example 11 is the workstation assembly of example(s) 1-10, wherein the support linkage is coupled between an upper region of the roller housing and an upper region of the slidable end panel, and wherein the deployable screen system further comprises a second support linkage coupled between a lower region of the roller housing and a lower region of the slidable end panel.

Example 12 is the workstation assembly of example(s) 1-11, wherein the screen is positioned between the support linkage and the stationary section when the door section is in the open position and the slidable end panel is in the extended position.

Example 13 is the workstation assembly of example(s) 1-12, wherein the deployable screen system further comprises: an additional roller assembly positioned within the roller housing; and an additional screen having a first end supported by the slidable end panel and a second end supported by the additional roller assembly, wherein the support linkage is positioned between the screen and the additional screen.

Example 14 is the workstation assembly of example(s) 1-13, wherein an exposed surface of the screen faces the stationary section when the door section is in the open position and the slidable end panel is in the extended position, and wherein the exposed surface of the screen is a uniform color.

Example 15 is the workstation assembly of example(s) 14, wherein an exposed surface of the additional screen faces away from the stationary section when the door section is in the open position and the slidable end panel is in the extended position, and wherein the exposed surface of the additional screen is different from the uniform color.

Example 16 is the workstation assembly of example(s) 1-15, wherein the first end of the screen includes a region of increased thickness, wherein the slidable end panel includes a retention channel having a vertical slot, and wherein the first end of the screen is supported by the slidable end panel by the region of increased thickness being positioned within the retention channel as the screen passes through the vertical slot.

Example 17 is the workstation assembly of example(s) 1-16, wherein the roller housing is removably coupled to the door section.

Example 18 is the workstation assembly of example(s) 1-17, wherein the door section includes i) a shelf; ii) an additional work surface; iii) a cabinet; iv) a drawer; v) a hanger bar; or vi) any combination of i-v.

Example 19 is a method, comprising: providing a workstation assembly having door section rotatably coupled to a stationary section; opening the workstation assembly by rotating the door section away from the stationary section; and extending a deployable screen by pulling a slidable end panel away from the door section, wherein pulling the slidable end panel away from the door section causes the deployable screen to unwrap from a roller assembly coupled to the door section.

Example 20 is the method of example 19, further comprising: removing the deployable screen, wherein removing the deployable screen includes uncoupling the roller assembly from the door section; attaching an alternate deployable screen, wherein attaching the alternate deployable screen includes coupling an alternate roller assembly to the door section; and extending the alternate deployable screen, wherein extending the alternate deployable screen includes pulling the slidable end panel away from the door section, wherein pulling the slidable end panel away from the door section causes the alternate deployable screen to unwrap from the alternate roller assembly.

What is claimed is:

1. A deployable screen system, comprising:

a roller housing supported above a floor;

a first roller assembly supported vertically within the roller housing;

a second roller assembly supported vertically within the roller housing;

a first screen having a first end coupled to the first roller assembly;

a second screen having a first end coupled to the second roller assembly; and a slidable end panel coupled to the roller housing by a support linkage, the slidable end panel movable between a retracted position adjacent the roller housing and an extended position spaced apart from the roller housing;

wherein the first roller assembly provides a biasing force to wrap a portion of the first screen about the first roller assembly when the slidable end panel is in the retracted position;

wherein the second roller assembly provides a biasing force to wrap a portion of the second screen about the second roller assembly when the slidable end panel is in the retracted position;

wherein a second end of the first screen is coupled to the slidable end panel such that movement of the slidable end panel to the extended position unwraps at least some of the portion of the first screen from the first roller assembly; and wherein a second end of the second screen is coupled to the slidable end panel such that movement of the slidable end panel to the extended position unwraps at least some of the portion of the second screen from the second roller assembly.

2. The deployable screen system of claim 1, wherein the slidable end panel is supported over the floor by a caster.

3. The deployable screen system of claim 1, wherein the support linkage comprises a first linkage arm having a first end rotatably coupled to the roller housing and a second linkage arm having a first end rotatably coupled to the slidable end panel, wherein a second end of the first linkage arm is rotatably coupled to a second end of the second linkage arm by a resistance coupling.

4. The deployable screen system of claim 1, wherein the support linkage is coupled between an upper region of the roller housing and an upper region of the slidable end panel, and wherein the deployable screen system further comprises a second support linkage coupled between a lower region of the roller housing and a lower region of the slidable end panel.

5. The deployable screen system of claim 4, wherein the support linkage and the second support linkage provide sufficient resistance to overcome the biasing force of the first roller assembly and the biasing force of the second roller assembly.

6. The deployable screen system of claim 1, wherein the support linkage is positioned such that the support linkage is located between the first screen and the second screen when the slidable end panel is in the extended position.

7. The deployable screen system of claim 1, wherein the first screen has an exposed surface that is a uniform color, and wherein the second screen has an exposed surface that is different than the exposed surface of the first screen.

8. The deployable screen system of claim 1, wherein the roller housing is coupled to a workstation having a work surface such that an exposed surface of the first screen faces the work surface when the slidable end panel is in the extended position.

9. The deployable screen system of claim 1, wherein the slidable end panel includes:

a first retention channel for receiving the second end of the first screen, wherein the first retention channel retains a region of increased thickness of the second end of the first screen; and a second retention channel for receiving the second end of the second screen, wherein the second retention channel retains a region of increased thickness of the second end of the second screen.

10. The deployable screen system of claim 9, wherein the first screen is removable by sliding the second end of the first screen out of the first retention channel and removing the first roller assembly from the roller housing.

11. The deployable screen system of claim 10, further comprising a replacement screen having a first end coupled to a replacement roller assembly, wherein the replacement roller assembly is couplable to the roller housing after removal of the first roller assembly, and wherein a second end of the replacement screen is slidably insertable into the first retention channel such that the first retention channel retains a region of increased thickness of the second end of the replacement screen.

12. A workstation for supporting the deployable screen system of claim 1, comprising:

a stationary section supporting a work surface; and a door section rotatably coupled to the stationary section and movable between a closed position and an open position, wherein the roller housing is coupled to the door section such that the slidable end panel can be moved to the extended position when the door section is in the open position.

13. A method, comprising:

providing a roller housing vertically supporting a first roller assembly and a second roller assembly, wherein a slidable end panel is coupled to the roller housing by a support linkage;

moving the slidable end panel from a retracted position adjacent the roller housing to an extended position spaced apart from the roller housing;

causing a first screen to unwrap from the first roller assembly and a second screen to unwrap from the second roller assembly in response to moving the slidable end panel to the extended position;

moving the slidable end panel from the extended position to the retracted position; and causing the first screen to wrap around the first roller assembly and the second screen to wrap around the second roller assembly in response to moving the slidable end panel to the retracted position.

14. The method of claim 13, wherein a biasing force of the first roller assembly facilitates causing the first screen to wrap around the first roller assembly and a biasing force of the second roller assembly facilitates causing the second screen to wrap around the second roller assembly.

15. The method of claim 14, wherein the support linkage, when the slidable end panel is in the extended position, provides sufficient resistance to overcome the biasing force of the first roller assembly and the biasing force of the second roller assembly.

16. The method of claim 13, wherein the first screen has a first end coupled to the first roller assembly and a second end coupled to the slidable end panel via a first retention channel, wherein the first retention channel retains a region of increased thickness of the second end of the first screen; and wherein the second screen has a first end coupled to the second roller assembly and a second end coupled to the slidable end panel via a second retention channel, wherein the second retention channel retains a region of increased thickness of the second end of the second screen.

17. The method of claim 16, further comprising:

removing the first screen, wherein removing the first screen includes:

sliding the second end of the first screen out of the first retention channel; and removing the first roller assembly from the roller housing.

18. The method of claim 17, further comprising:

adding a replacement screen, the replacement screen having a first end coupled to a replacement roller assembly, wherein adding the replacement screen includes:

sliding a second end of the replacement screen into the first retention channel; and coupling the replacement roller assembly to the roller housing.

19. The method of claim 13, wherein the roller housing is coupled to a workstation having a work surface such that an exposed surface of the first screen faces the work surface when the slidable end panel is in the extended position.

20. The method of claim 13, wherein providing the roller housing comprises:

providing a workstation having a stationary section supporting a work surface, and providing a door section rotatably coupled to the stationary section and movable between a closed position and an open position, wherein the roller housing is coupled to the door section such that the slidable end panel can be moved to the extended position when the door section is in the open position.

* * * * *